United States Patent [19]

Lange

[11] 4,267,450

[45] May 12, 1981

[54] METHOD OF ELIMINATING BACKGROUND RESIDUAL CHARGE IN ELECTROPHOTOGRAPHIC IMAGE REPRODUCTION AND APPARATUS FOR CARRYING OUT SAID METHOD

[75] Inventor: Gottfried Lange, Erlangen, Fed. Rep. of Germany

[73] Assignee: Siemens Aktiengesellschaft, Berlin & Munich, Fed. Rep. of Germany

[21] Appl. No.: 856,006

[22] Filed: Nov. 30, 1977

[30] Foreign Application Priority Data

Dec. 22, 1976 [DE] Fed. Rep. of Germany ..... 2658280

[51] Int. Cl.[3] ..... G03G 13/00; G03G 15/00

[52] U.S. Cl. ..... 250/315.2; 430/103; 118/654; 355/3 DD; 427/14.1

[58] Field of Search ..... 250/315 R, 315 A; 96/1 R, 1 C, 1 SD; 427/12, 14, 19; 118/654; 355/3 DD; 430/103, 97

[56] References Cited

U.S. PATENT DOCUMENTS

| | | | |
|---|---|---|---|
| 3,603,790 | 9/1971 | Cleare | 250/315 A |
| 3,813,546 | 5/1974 | Proudian | 250/315 |
| 3,949,222 | 4/1976 | Lewis | 250/315 A |
| 3,967,891 | 7/1976 | Rippstein | 96/1 C |
| 3,997,259 | 12/1976 | Bhagat | 96/1 C |
| 4,027,158 | 5/1977 | Reiss | 250/315 R |

FOREIGN PATENT DOCUMENTS

| | | | |
|---|---|---|---|
| 1522595 | 7/1972 | Fed. Rep. of Germany . | |
| 873080 | 7/1961 | United Kingdom | 96/1 R |

OTHER PUBLICATIONS

Thomas L. Thourson, "Xeroradiography," *SPIE* vol. 56 (1975), pp. 225 to 235.

*Primary Examiner*—Davis L. Willis
*Assistant Examiner*—Thomas P. O'Hare
*Attorney, Agent, or Firm*—Hill, Van Santen, Steadman, Chiara & Simpson

[57] ABSTRACT

In an exemplary embodiment, a charge image resulting from x-ray exposure of a plate originally charged to 1.5 to 5 kV, is developed by applying powder of opposite polarity while applying a voltage of from 1 to 4.5 kV, also of opposite polarity, to a conductive backing for neutralizing the effect of image background charge. A grid is spaced a small distance from the charge image and receives a voltage of about 1000 volts for controlling edge emphasis. For a positive charge image and negatively charged powder, a negative potential of e.g. −2500 volts may be applied to the backing for the photoconductive layer and +1000 volts may be applied to the grid.

2 Claims, 1 Drawing Figure

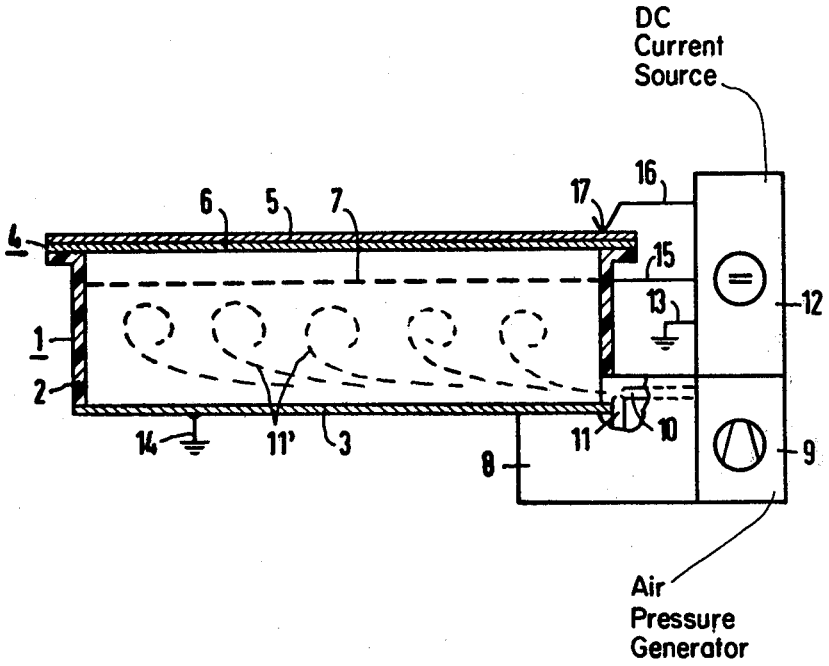
DC
Current
Source
16
17
6
5
7
4
15
13
12
1
2
14
11'
3
11
10
8
9
Air
Pressure
Generator

METHOD OF ELIMINATING BACKGROUND RESIDUAL CHARGE IN ELECTROPHOTOGRAPHIC IMAGE REPRODUCTION AND APPARATUS FOR CARRYING OUT SAID METHOD

BACKGROUND OF THE INVENTION

The invention relates to methods and apparatus for eliminating the background residual charge of a charge image produced on a photoconductive layer. A method such as this e.g. known from the U.S. Pat. No. 4,027,158 issued May 31, 1977.

In the case of known electrophotographic procedures with photoconductive layers such as those consisting of amorphous selenium, the surface of the plate is positively or negatively charged to a high potential (approximately 1 to 5 kV). The plate prepared in this manner is exposed to the reception of irradiation such that a change in the electric conductivity is obtained in the photoconductive layer such as to affect the intensity distribution in the image. A corresponding discharge results, so that a charge image is obtained which can be rendered visible with the various means known in electrophotography. The most common procedure is e.g. to render visible by means of a coating of colored pigment which is dependent upon the charge, in particular, by means of a dusting process carried out with a dielectric powder of suitable color.

As previously already mentioned, the charge image results by virtue of the fact that the photoconductive layer is charged to a high potential in the range from about one to five kilovolts (1 to 5 kV) in relation to its base. In the exposure process, the image is then produced in that the cited charge or voltage is reduced by several hundred volts. Even an underexposed selenium plate differs from a normally exposed selenium plate only by virtue of the contrast, given an identical base optical density. The particles of the dielectric color powder—the so-called toner particles—during approximation to the charge image, are essentially orientated to the fields produced as the consequence of the charge differences and possibly as a consequence of separate auxiliary fields. The toner granules must here be selected in such a fashion that they will result in an image in spite of the high background (or base) residual charge of the plate. They cannot be overly sensitive; i.e., too finely granulated, and they can be provided only with a relatively low specific charge.

In order for only the image-related charge peak pattern to be operative (or effective) without the background (or base) residual charge during development, if possible, in accordance with the German Auslegeschrift No. 1,522,595, for example, in order to eliminate the large background (or base) residual charge as compared with the charge differences in the image regions to be coated with toner, a charge is to be applied between the photographing of the charge-image and its visualization, said charge being correspondingly opposite to the charge of the image. As a consequence, the base (or background) is to be neutralized, and the image-related charge peak pattern can be better developed. This is to proceed e.g. in a corona discharge having a high discharge voltage. In order to avoid a leveling of the non-uniform image-related charge distribution; i.e., the image contrast, which would occur because the charge carriers follow the field lines and more strongly discharge the locations having a higher potential than those of a lower potential, a charging by means of a charge source was carried out in accordance with the U.S. Pat. No. 4,027,158, said charge source being guided in a scanning fashion at a distance over the surface (or area) to be charged, said distance lying in the order of magnitude of the desired image resolution, and wherein the charge carrier source is operated in the current saturation range. However, this method requires a very precise adherence to the distance (or spacing), a fact which present difficulties due to the large image surfaces (or areas). In addition to a precise guidance of the charge carrier source, the surface of the xerographic plate—i.e., the selenium layer—must exhibit a very precise planarity in order than no electric arcings and consequent destructions of the image will occur given the small distances between the two units.

SUMMARY OF THE INVENTION

The object which is the basis of the invention consists in obtaining a simplified fashion a charge image produced on a photoconductive layer in a method of eliminating the background (or base) residual charge.

By applying a voltage at least substantially corresponding to the background (or base) residual voltage but having an opposite polarity, the attractive force of the residual charge on the toner particles in the development chamber is eliminated. There then remains—at least in an approximation—only the voltage peak pattern, modulated by the x-radiation, as the attractive force acting on the toner particles. In this manner, the darkening of the base which is unavoidable in known powder cloud development chambers is prevented. The contrast transfer function, as measurements have shown, is thereby improved by a factor of three.

In order to carry out the invention, random known development apparatus for powder cloud development of xerographic plates can be used. Plates such as these are e.g. described in SPIE Vol. 56 (1975) "Medical X-Ray Photo-Optical Systems Evaluation" pages 225 to 235, particularly pages 228/229. The change in the so-called bias voltage—i.e., the voltage to which the carrier of the selenium layer is connected, which is provided therein for the purpose of reversal of the image contrast; i.e., for obtaining a positive or a negative image, is selected in magnitude corresponding to the basic (or original) charge applied prior to the photograph onto the xerographic plate. In accordance with the invention, however, adjustments are made such that there is only a compensation of the background (or minimum) residual voltage which results from maximum transmitted x-ray energy during the photographic exposure, and upon which is superimposed the charge peak pattern carrying the image. Given the conventional utilization of a selenium layer and an original charge in the range from 1.5 to 5 kV, a residual background charge can be expected which can be compensated with a bias voltage of e.g. 1 to 4.5 kV and of opposite polarity to the basic (or original) charge.

Details of the invention shall be further explained in the following on the basis of the illustrated sample embodiment, and other objects, features and advantages of the invention will be apparent from the following detailed description taken in connection with the accompanying sheet of drawings.

BRIEF DESCRIPTION OF THE DRAWINGS

The single FIGURE illustrates an exemplary embodiment of the present invention by means of a somewhat diagrammatic view, including a development chamber with an associated exposed xerographic plate (both shown in cross section), and including associated electrical and mechanical components (indicated by conventional drawing symbols).

DETAILED DESCRIPTION

The construction of the installation externally substantially corresponds to the known construction, and consists of a box-like development chamber 1, exhibiting lateral walls 2 consisting of an insulating material, and a base 3 consisting of electrically conductive material. The cover is formed by a xerographic plate 4 consisting of an aluminum plate 5 and a selenium layer 6 which faces the interior space of the chamber 1. In the cited interior space, a grid or screen 7 is disposed in front of the free surface of the selenium layer and parallel thereto. It is constructed from wires consisting of a material such as tungsten, molybdenum, platinum, nickel, or steel, etc. having a cross sectional dimension (thickness) of approximately fifty to two hundred microns (50 to 200μ) and having a distance from one another or opening dimension in the range of approximately two to eight millimeters (2 to 8 mm). In order for the development installation to become operative, a receptacle 8 for the toner powder and an air pressure generator 9 are provided, on the one hand. From this air pressure generator 9, air is conveyed under a pressure of 1.5 to 2 atmospheres excess pressure to a nozzle (or jet) 10, which, together with the nozzle 11 coming from receptacle 8, forms a spray device. The spray direction is aimed into chamber 1.

In addition, a DC current source 12 is provided for the electric supply. Supply with the necessary potentials proceeds from the latter DC current source. The one pole (or terminal) is connected to a ground 13. Base 3 of chamber 1 is also provided with a grounding connection 14. Grid 7 is connected to the DC current source 12 via line 15, and a contacting electric contact 17 is connected to said DC current source 12 via a line 16. The contacting electric contact 17 is connected to aluminum plate 5; i.e., the carrier of the selenium layer 6.

In utilizing a xerographic plate 4 with a selenium layer 6 having a thickness in the range from one hundred to five hundred microns (100 to 500μ), a basic (or fundamental) charge of 1 to 5 kV is applied in a known fashion for the purpose of making a photograph. After the photograph e.g. a charge peak pattern of 2500 to 3000 V is to be expected. Adapted in polarity and magnitude, a bias voltage of minus twenty-five hundred volts (−2500 V) is to be applied to said charge peak pattern via contacting electric contact 17 to plate 5 in order to compensate the background (or base) residual charge lying beneath the peak pattern; i.e., below 2500 V. As a consequence, a reduction of the background (or base) charge which may otherwise be detrimental to the resulting images is achieved in the case of the previously cited thick selenium layers which are of particular importance for x-ray photographs and in the case of which high charges are necessary. Thus, the image information is obtained even when applying high basic (or fundamental) charges which are necessary for good sensitivity, without resulting in a reduction of the initially present image contrast.

In the previously cited example, the grid 7 is arranged at a spacing of twenty millimeters (a 20 mm-interval) from layer 6 of plate 4. In addition, a voltage of 1000 V is applied thereto. Grid or screen 7, in a general definition, should have a large mesh size in comparison with the dimensions of the particles of the toner powder and it should have thin wires in comparison with the large mesh-size in order that the passage of the toner powder is not subject to any significant mechanical obstruction. Spacing distances in the range from two to thirty millimeters (2 to 30 mm) have been proven effective as the spatial interval between screen 7 and layer 6. The dimensions of the grid 7 should also be selected as a function of the spatial interval; for example, such that the spatial interval relative to the dimension of the mesh openings (the gaps between the wires 7 as seen in the drawing figure) is three to one (3/1), and a reproduction of the grid 7 itself will be avoided. The closer the grid is disposed to plate 4, the more intensive the effect will be. (The screen 7 is indicated entirely diagrammatically in the drawing.)

The applied voltage permits a change in the character of the image. Without a screen or grid 7, or without application of a voltage to the grid 7, a strong emphasis (or enhancement) of the image edges is obtained. However, the greater the field produced by applying a positive as well as a negative potential, the greater the reduction in edge-emphasis (or enhancement). Fields of 50 to 600 volts per centimeter have been proven suitable. The voltage to be applied, however, is upwardly limited (or bounded) by the breakdown field strength occurring in the region of development.

With a positive charge image, negatively charged powder is capable of being driven by the applied air pressure through the relatively large openings of positively charged screen 7. The openings may have an area from 4 to 64 square millimeters while the diameter of the wires of the screen is from 50 to 200 microns. Any positively charged powder tends to be repelled by the positively charged screen 7; further, the negative potential applied at contact 17 (taking account of the dielectric properties of layer 6) is less than that required to retain positively charged powder on the image. For the specific embodiment illustrated, the minimum or background charge for the image may correspond to a potential greater than that applied to screen 7, and to a potential e.g. about 500 volts less than the original charge applied to layer 6 prior to exposure to x-ray energy; then the compensating voltage applied at contact 17, may be about equal in magnitude but opposite in polarity to such image minimum or background charge, with a magnitude about 500 volts less than the originally applied charge. As a specific example, if the original uniform charge applied to the surface of photoconductor 6 is plus 3000 volts, then during development, minus 2500 volts might be applied at contact 17, and plus 1000 volts applied at conductor 15.

It will be apparent that many modifications and variations may be effected without departing from the scope of the novel concepts and teachings of the present invention.

I claim as my invention:

1. Apparatus for carrying out a method of eliminating the residual charge of a charge-image produced on a photoconductive layer associated with a conductive backing, wherein the charge image is treated with powder of electrically opposite polarity, characterized in that a voltage is applied to the conductive backing for the photoconductive layer during treating of the layer with development powder, which voltage is of a polarity opposite to that of the charge image and of a magnitude for substantially compensating the residual charge remaining as a residue after an initial uniform charge is reduced according to the maximum reduction attained during the exposure process, said apparatus being characterized in that there is provided a development apparatus comprising a development chamber (1), a contact (17) via which a DC voltage is connected for supplying voltage to the conductive backing (5) of the photoconductive layer (6), and a device (9 through 11) producing powder clouds for supplying powder to the photoconductive layer (6), said contact (17) supplying a voltage which is electrically opposite to the background residual charge and approximating the latter in magnitude, said apparatus being characterized in that a grid (7) is arranged in the chamber (1) at a small distance in front of and parallel to layer (6), said grid (7) being connected during operation of the apparatus to a voltage of approximately 1000 volts.

2. Apparatus according to claim 1, characterized in that the distance of the grid (7) from the layer (6) amounts to 2 to 30 mm, and that the applied voltage produces an electric field lying below the break-down field strength and, in particular, between 50 and 600 volts per centimeter.

* * * * *